US009321067B2

(12) United States Patent
Schaer, III et al.

(10) Patent No.: US 9,321,067 B2
(45) Date of Patent: Apr. 26, 2016

(54) SEAL CARTRIDGE FOR A ROTATING NOZZLE ASSEMBLY

(75) Inventors: John B. Schaer, III, Chappel Hill, TX (US); David Shane Gregory, Houston, TX (US); Kasi Amaravadi, Tomball, TX (US)

(73) Assignee: Federal Signal Corporation, Oak Brook, IL (US)

( * ) Notice: Subject to any disclaimer, the term of this patent is extended or adjusted under 35 U.S.C. 154(b) by 1146 days.

(21) Appl. No.: 12/832,579

(22) Filed: Jul. 8, 2010

(65) Prior Publication Data

US 2012/0006910 A1 Jan. 12, 2012

(51) Int. Cl.

| | |
|---|---|
| ***B05B 3/02*** | (2006.01) |
| ***B05B 3/04*** | (2006.01) |
| ***B05B 3/06*** | (2006.01) |
| ***B05B 3/00*** | (2006.01) |
| ***B05B 15/06*** | (2006.01) |

(52) U.S. Cl.

CPC ..... *B05B 15/065* (2013.01); *B05B 3/02* (2013.01); *B05B 3/025* (2013.01); *B05B 3/06* (2013.01); *Y10T 137/0441* (2015.04)

(58) Field of Classification Search

CPC ..... B05B 3/02; B05B 15/065; B05B 3/06; B05B 3/025

USPC ..... 239/259, 264, 225.1, 240, 251, 261, 239/222.11, 222.13, 222.15; 277/500, 616, 277/609; 137/15.08; 285/279–281, 353, 285/384, 272, 275, 282

See application file for complete search history.

(56) References Cited

U.S. PATENT DOCUMENTS

| | | | | | |
|---|---|---|---|---|---|
| 1,845,364 | A | * | 2/1932 | Thompson | 239/259 |
| 2,227,105 | A | * | 12/1940 | Pritchard | 285/281 |
| 2,301,038 | A | * | 11/1942 | Guarnaschelli | 285/275 |
| RE22,309 | E | * | 5/1943 | Guarnaschelli | 285/275 |
| 2,574,183 | A | * | 11/1951 | Holmes | 239/256 |
| 2,712,457 | A | * | 7/1955 | Kimbro | 285/278 |
| 2,928,608 | A | * | 3/1960 | Royer | 239/230 |
| 2,946,517 | A | * | 7/1960 | Jacoby | 239/264 |
| 2,980,341 | A | * | 4/1961 | Royer et al. | 239/261 |
| 3,089,713 | A | * | 5/1963 | Scaramucci | 285/14 |
| 3,120,346 | A | * | 2/1964 | Willhoite | 239/214.13 |
| 3,129,960 | A | * | 4/1964 | Schrodt | 285/95 |
| 3,347,464 | A | * | 10/1967 | Hruby, Jr. | 239/210 |
| 3,764,073 | A | * | 10/1973 | Costa et al. | 239/230 |
| 3,889,983 | A | | 6/1975 | Freize et al. | |
| 3,937,494 | A | * | 2/1976 | Hicks | 285/13 |
| 3,957,205 | A | * | 5/1976 | Costa | 239/230 |

(Continued)

FOREIGN PATENT DOCUMENTS

| | | |
|---|---|---|
| DE | 102004022587 | 12/2005 |
| DE | 202008002597 | 4/2008 |

(Continued)

*Primary Examiner* — Len Tran
*Assistant Examiner* — Steven M Cernoch
(74) *Attorney, Agent, or Firm* — Merchant & Gould P.C.

(57) ABSTRACT

A seal cartridge and a rotating nozzle assembly utilizing the seal cartridge are disclosed. The main seal member in the nozzle assembly is mounted as part of the seal cartridge. The seal cartridge is also easily removable from the rotating nozzle assembly without requiring the separate removal of the main seal member from the seal cartridge. This configuration allows a user to quickly install a new or rebuilt seal during an operation while minimizing or eliminating the necessity to manipulate small parts in the field.

20 Claims, 7 Drawing Sheets

(56) References Cited

U.S. PATENT DOCUMENTS

| | | | | | |
|---|---|---|---|---|---|
| 4,062,494 | A | | 12/1977 | Healy | |
| 4,272,108 | A | | 6/1981 | Maasberg | |
| 4,561,681 | A | | 12/1985 | Lebsock | |
| 4,690,325 | A | | 9/1987 | Pacht | |
| 4,715,539 | A | | 12/1987 | Steele | |
| 4,744,517 | A | * | 5/1988 | Iwamoto et al. | 239/263 |
| 4,817,995 | A | | 4/1989 | Deubler et al. | |
| 5,060,862 | A | | 10/1991 | Pacht | |
| 5,060,863 | A | | 10/1991 | Hammelmann | |
| 5,104,043 | A | | 4/1992 | Pacht | |
| 5,203,842 | A | | 4/1993 | Mark et al. | |
| 5,248,095 | A | * | 9/1993 | Rankin et al. | 239/261 |
| 5,402,936 | A | * | 4/1995 | Hammelmann | 239/263.1 |
| 5,685,487 | A | * | 11/1997 | Ellis | 239/261 |
| 5,909,848 | A | | 6/1999 | Zink | |
| 6,027,040 | A | | 2/2000 | Frye-Hammelmann | |
| 6,029,695 | A | | 2/2000 | Logan | |
| 6,059,202 | A | | 5/2000 | Zink et al. | |
| 6,149,733 | A | * | 11/2000 | Djumlija et al. | 134/32 |
| 6,481,885 | B2 | * | 11/2002 | Dupre | 366/137 |
| 6,698,669 | B2 | | 3/2004 | Rieben | |
| 6,886,832 | B2 | | 5/2005 | Forrest | |
| 6,913,266 | B2 | | 7/2005 | Jarchau et al. | |
| 7,108,293 | B2 | * | 9/2006 | Van Der Meijden et al. | 285/275 |
| 7,273,188 | B2 | * | 9/2007 | Saha | 239/237 |
| 7,316,363 | B2 | | 1/2008 | Hume et al. | |
| 7,354,075 | B2 | * | 4/2008 | Hagen | 285/143.1 |
| 7,404,581 | B2 | * | 7/2008 | Baving et al. | 285/242 |
| 7,546,959 | B2 | | 6/2009 | Wagner et al. | |
| 7,584,906 | B2 | * | 9/2009 | Lev | 239/382 |
| 7,600,700 | B2 | | 10/2009 | Trunick et al. | |
| 7,624,935 | B2 | * | 12/2009 | Nelson et al. | 239/252 |
| 7,635,096 | B2 | | 12/2009 | Wright et al. | |
| 7,637,508 | B2 | | 12/2009 | Montipo | |
| 7,654,583 | B2 | * | 2/2010 | Kvamme et al. | 285/276 |
| 2001/0008257 | A1 | * | 7/2001 | Scholz et al. | 239/703 |
| 2009/0206557 | A1 | | 8/2009 | Wright | |
| 2010/0187330 | A1 | * | 7/2010 | Healy | 239/230 |

FOREIGN PATENT DOCUMENTS

| | | |
|---|---|---|
| EP | 1890068 | 2/2008 |
| EP | 2 278 162 A1 | 1/2011 |

* cited by examiner

SEAL CARTRIDGE FOR A ROTATING NOZZLE ASSEMBLY

TECHNICAL FIELD

This application relates to seal cartridges for use in ultra high pressure rotating nozzles. Related methods are also disclosed.

BACKGROUND

In high-pressure water blasting operations, it is often desirable to rotate a nozzle head to increase surface coverage, and thus productivity. However, sealing between the stationary and rotating components of the water blasting system must be addressed. The high-pressure environment and relative motion between components accelerate wear on the sealing components. For this reason, the sealing components must be changed regularly. The length of time required for this maintenance reduces the productivity of the water blasting system. Multiple solutions have been developed to address this sealing problem.

In one solution, in which seal members are not used, the stationary and rotating components are separated by a very small space, for example less than a thousandth of an inch. The working fluid is allowed to escape through this space. Since there is no contact between the components, friction is minimized. In this solution, the power used to pressurize the fluid which escapes is wasted as it does not flow through the nozzle. At ultra-high pressures, near 40,000 PSI, this can be as much as 30% of the power used in the system.

In another solution, sealing is accomplished using a plastic seal member bearing against a metal mandrel. The pressure of the working fluid forces the plastic seal member against the mandrel, preventing the working fluid from escaping. The plastic seal member is typically supported by a metal backup bushing. While this seal design is quite popular, the maintenance of this design is complicated and time consuming. This seal design uses a number of small parts which are removed and replaced separately. Removing and installing these small parts increases the time required to service the assembly, decreasing overall water blasting system productivity. Further, as such parts are often changed in the field, there is an inherent risk that some of the parts may be mishandled and either damaged or lost. Improvements are desired.

SUMMARY

A seal cartridge and an ultra high pressure rotating nozzle assembly incorporating the seal cartridge are disclosed. The main seal member in the nozzle assembly is mounted as part of the seal cartridge. The seal cartridge is also easily removable from the rotating nozzle assembly without requiring the separate removal of the main seal member, or its associated backup bushing. This configuration allows a user to quickly install a new or rebuilt seal during an operation while minimizing or eliminating the necessity to manipulate smaller individual parts in the field.

In one embodiment, the seal cartridge includes a mandrel having an exterior surface and an internal fluid path in which the mandrel has an upstream end with a first cross-sectional diameter and a downstream end with a second cross-sectional diameter that is smaller than the first cross-sectional diameter. Also included is a retaining member that is disposed about the mandrel and is constructed and arranged to connect the seal cartridge to the rotating nozzle assembly. The seal cartridge also includes a main seal member and a backup bushing, both of which are disposed about a portion of the exterior surface of the mandrel. The main seal member is in direct contact with the mandrel while there is a small clearance gap between the backup and the mandrel. The seal cartridge can also include an upstream seal member and a downstream seal member oriented to create a seal about the exterior surface of the seal cartridge. In addition to, or instead of, the upstream seal member, the downstream end of the mandrel can have a straight tapered shape or a radiused shape for forming a seal against a tapered or radiused seal surface of the nozzle shaft. The main seal member can be shaped to have a downstream surface that slopes towards the exterior surface of the mandrel in a direction towards the downstream end of the mandrel. In such a case, the backup bushing can also have a sloped upstream surface that is in at least partial contact with the downstream surface of the main seal member. The seal cartridge can also have a retainer, such as a retaining ring, constructed and arranged to hold the main seal, backup bushing and retaining member onto the mandrel. Further, the mandrel of the seal cartridge can be directly coupled to a rotating shaft within the rotating nozzle assembly by an engagement mechanism.

Also, the seal cartridge can be assembled by (a) installing a retaining member onto a mandrel that has an upstream end and a downstream end wherein the mandrel defines an internal fluid path; (b) installing a backup bushing onto the mandrel from the upstream end of the mandrel such that the backup bushing and retaining member can be brought into contact with each other; and (c) installing a main seal member directly onto the mandrel from the upstream end of the mandrel such that the main seal member and the backup bushing can be brought into contact with each other. In another step, a retainer can be installed directly onto the mandrel from the upstream end of the mandrel so as to secure the main seal member and backup bushing onto the mandrel. However, the friction between the seal member and the mandrel, in certain embodiments, can also provide the necessary resistance to hold the main seal member, the backup bushing and the retaining member onto the mandrel. Other possible steps in the assembly process are installing an upstream seal member and installing a downstream seal member onto the seal cartridge so as to create a seal about the exterior surface of the seal cartridge.

A rotating nozzle assembly is also disclosed that includes the above described seal cartridge, and can also include a seal cartridge housing directly connected to the seal cartridge via the retaining member of the seal cartridge, a nozzle housing directly connected to the seal cartridge housing, a nozzle shaft directly coupled to the mandrel of the seal cartridge, and a rotating nozzle head directly coupled to the nozzle shaft. The rotating nozzle assembly can be serviced by installing a fully assembled seal cartridge into the rotating nozzle assembly, by securing the fully assembled seal cartridge to the seal cartridge housing, and by securing the seal cartridge housing to the housing of the rotating nozzle assembly. Once the seal cartridge is spent, the fully assembled seal cartridge from the rotating nozzle assembly can be removed and replaced with a new seal cartridge. By use of the term "fully assembled", it is meant to indicate that the seal cartridge remains intact during the installation and removal process such that the subcomponents of the seal cartridge are not further separated from the mandrel at any point during the process.

DETAILED DESCRIPTION

Figure 1:
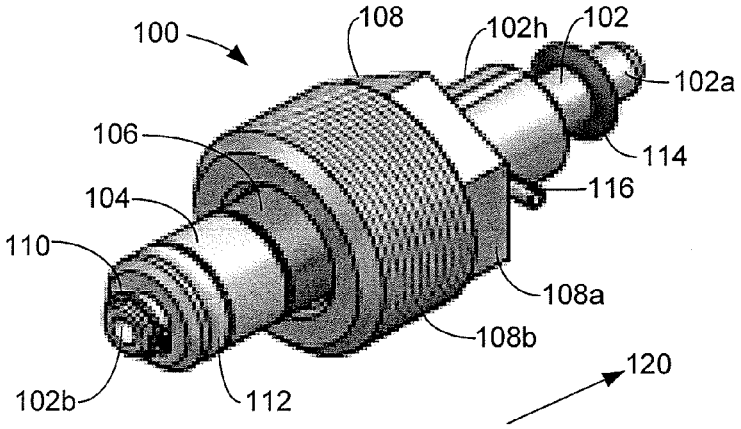
FIG. 1 is a perspective view of a first embodiment of a seal cartridge.
Figure 2:
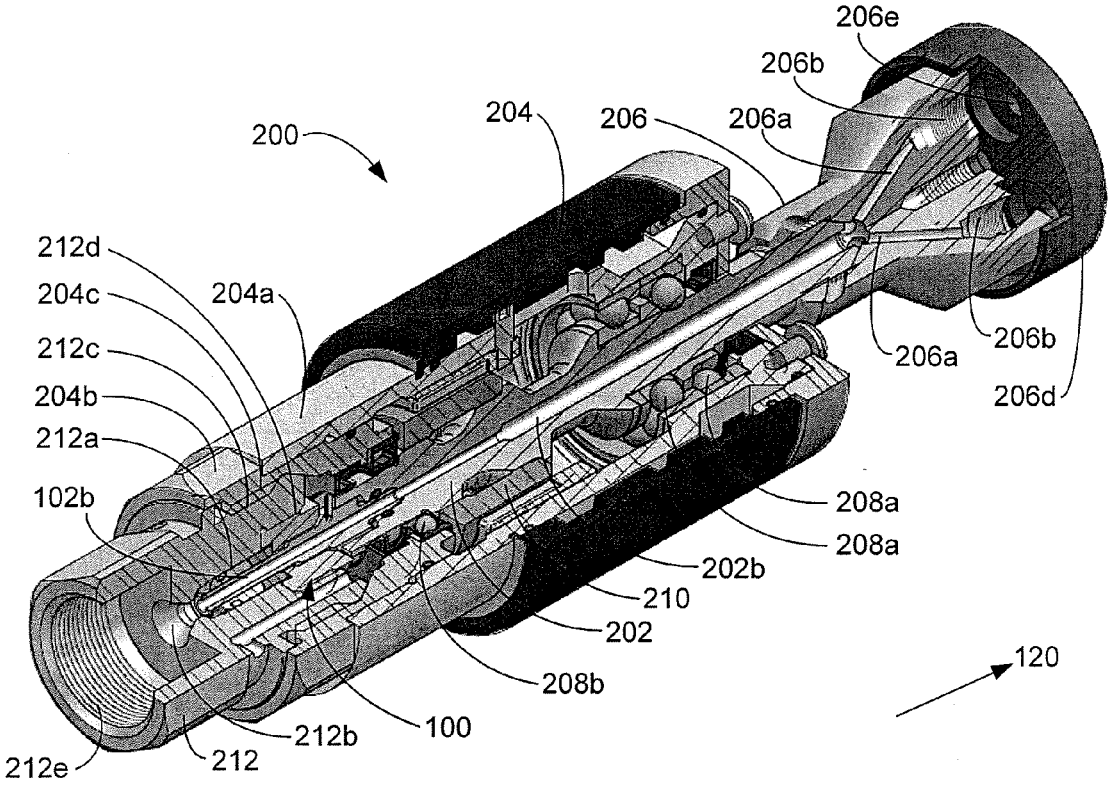
FIG. 2 is a perspective, cut-away view of a rotating nozzle assembly within which the seal cartridge of FIG. 1 is installed.
Figure 3:
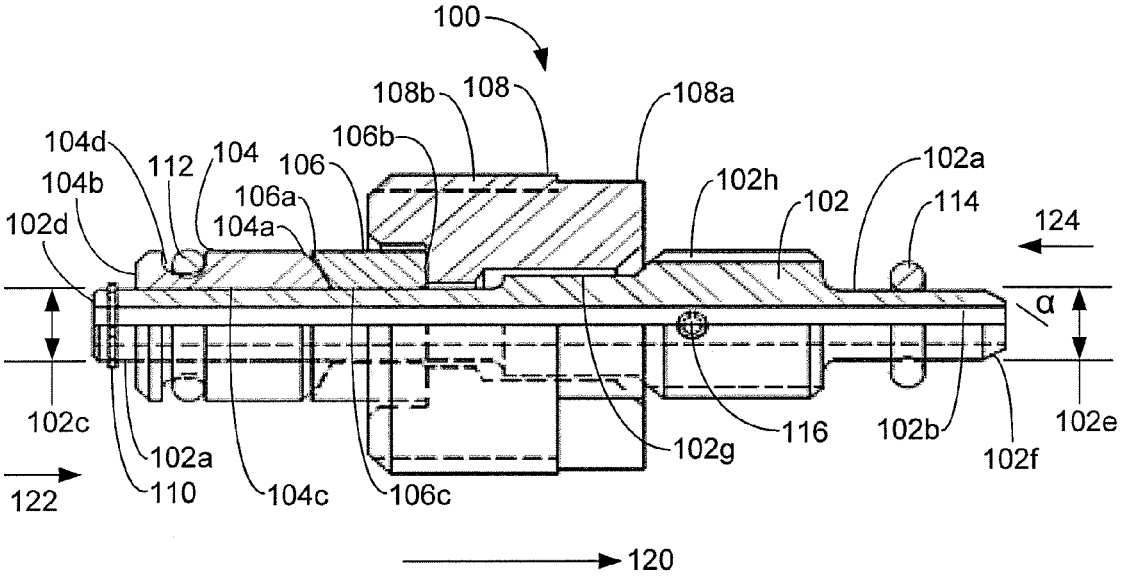
FIG. 3 is a combined cross-sectional, side view of the seal cartridge of FIG. 1.
Figure 4:
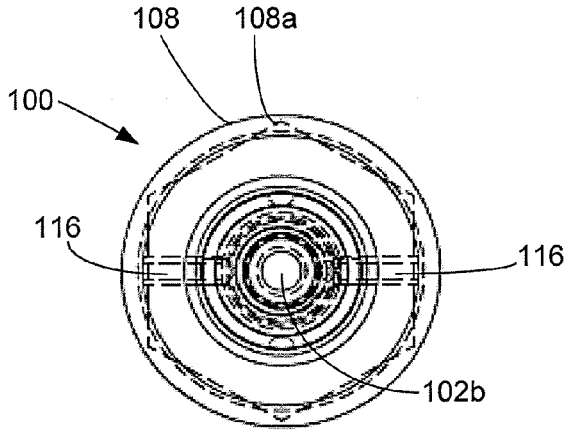
FIG. 4 is an upstream end view of the seal cartridge of FIG. 1.
Figure 5:
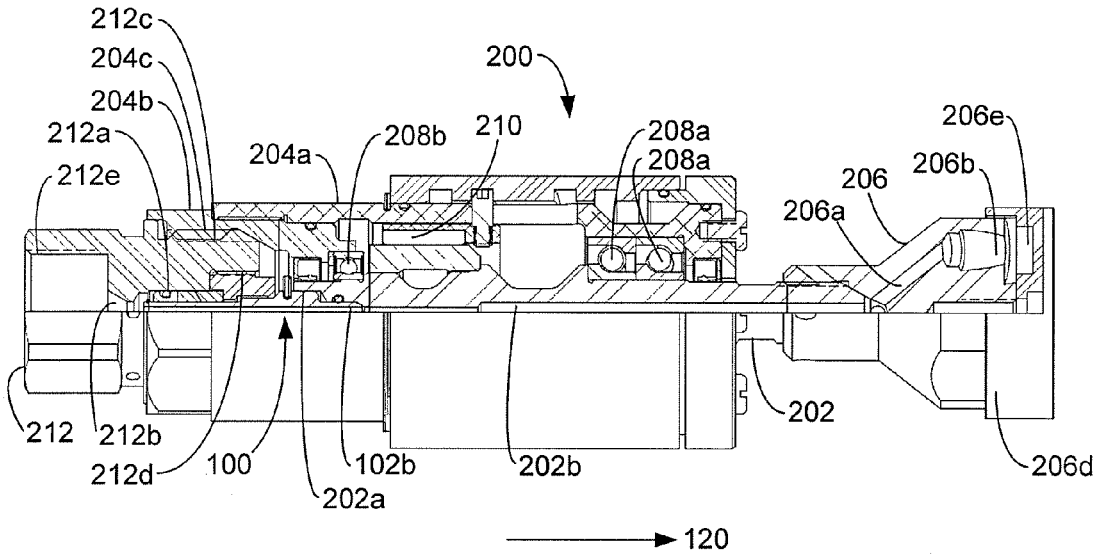
FIG. 5 is a combined cross-sectional, side view of the nozzle assembly of FIG. 2 within which the seal cartridge of FIG. 1 is installed.
Figure 6:
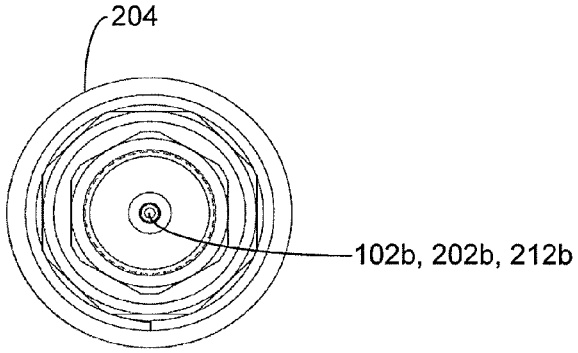
FIG. 6 is an upstream end view of the nozzle assembly of FIG. 2 within which the seal cartridge of FIG. 1 is installed.

This disclosure relates to seal cartridges for use in ultra high pressure rotating nozzles. FIG. 1 represents one embodiment of an uninstalled seal cartridge 100 that can be installed within a rotating nozzle assembly 200. FIG. 2 shows the seal cartridge 100, as installed in the rotating nozzle assembly 200. FIGS. 3-4 show additional views of seal cartridge before or after installation into the rotating nozzle assembly 200. FIGS. 5-6 show additional views of the rotating nozzle assembly 200 with the seal cartridge 100 installed therein. The following paragraphs describe the various components and functions of both the seal cartridge 100 and the nozzle assembly 200.

In the embodiment shown, seal cartridge 100 includes a mandrel 102. Mandrel 102 is a rotating component for providing an interior flow path through which pressurized fluid can flow, for providing a positive pressure bias when pressurized fluid (not shown) is flowing through the mandrel, and for providing a sealing surface to prevent pressurized fluid from escaping the nozzle assembly 200 in which the seal cartridge is installed. By the use of the term "positive pressure bias" it is meant that the mandrel is configured such that the pressurized fluid exerts a net pressure or force on the mandrel in the same direction as the pressurized fluid is flowing. As can be best seen at FIGS. 3-4, the mandrel 102 defines an exterior surface against which main seal member 104, discussed later, can form a seal.

Mandrel 102 also defines an interior flow path 102*b* through which the pressurized fluid can flow. As shown at FIG. 3, the pressurized fluid flows in a first direction 120 from an upstream end 102*d* to a downstream end 102*f*. By use of the term "upstream end" it is meant to identify the end of the mandrel nearest to which pressurized fluid flows into the internal flow path 102*b*. By the use of the term "downstream end", it is meant to identify the end of the mandrel nearest to which pressurized fluid flows out of the internal flow path 102*b*. The upstream end 102*d* has a cross-sectional diameter 102*c* while the downstream end 102*f* has a cross-sectional diameter 102*e* that is less than the cross-sectional diameter 102*c*. This difference in diameters results in the upstream end 102*d* of the mandrel 102 having a greater cross-sectional surface area than the downstream end 102*f*. As such, when the mandrel 102 is exposed to the pressurized fluid, the fluid exerts a first pressure 122 on the upstream end 102*d* and a second pressure 124 on the downstream end 102*f*. Because the cross-sectional area of the upstream end 102*d* is greater than the cross-sectional area of the downstream end 102*f*, the pressurized fluid will create a net force on the mandrel in the direction of pressurized fluid flow 120. Thus, a positive pressure bias is created on the mandrel by the pressurized fluid. This pressure bias is further enhanced by the frictional forces between the pressurized fluid and the internal flow path 102*b* of the mandrel 102 that creates a pressure drop between the upstream and downstream ends. The benefit of the positive pressure bias is that the seal cartridge 100 will be inherently maintained in its desired position within nozzle assembly 200 when pressurized fluid is flowing, thereby eliminating the need to further secure the seal cartridge 100 to the nozzle assembly 200 by mechanical or other means.

Figure 7:
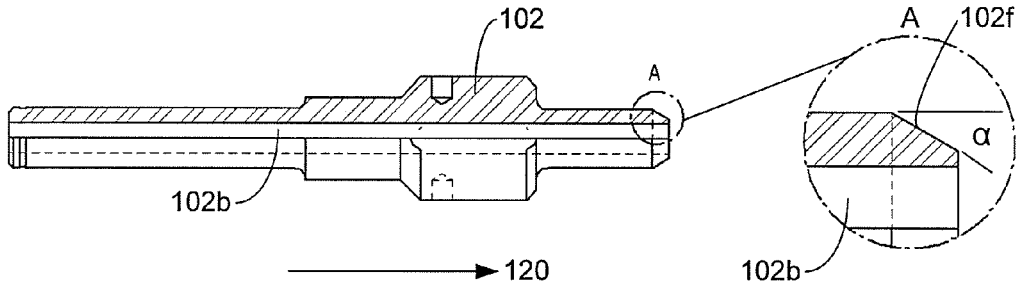
FIG. 7 is a combined cross-sectional, side view of a first embodiment of a mandrel suitable for use in the seal cartridge of FIG. 1.
Figure 8:
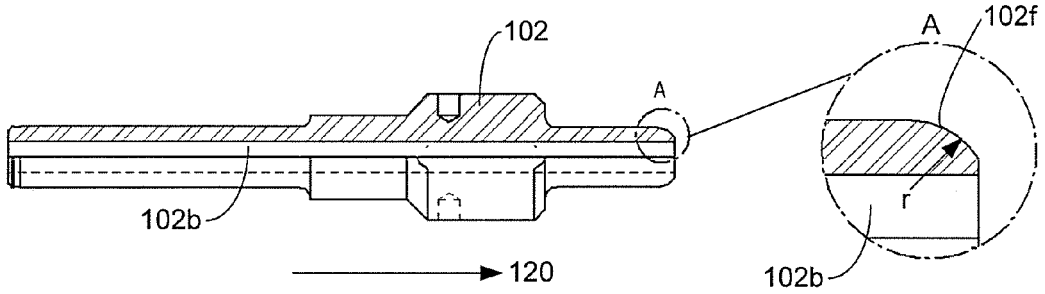
FIG. 8 is a combined cross-sectional, side view of a second embodiment of a mandrel suitable for use in the seal cartridge of FIG. 1.
Figure 9:
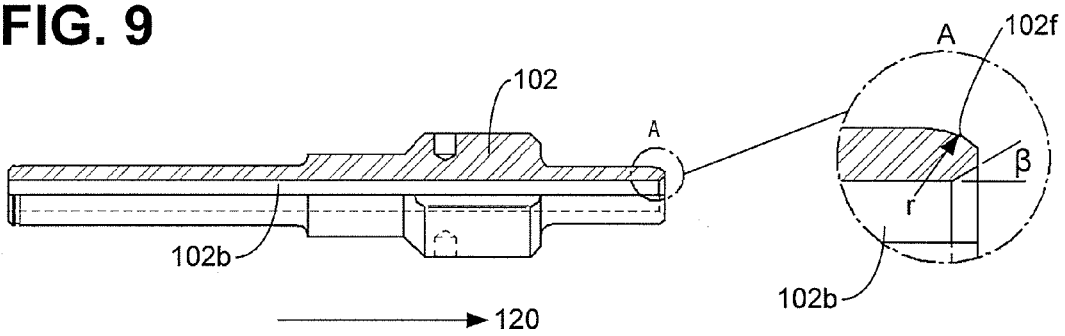
FIG. 9 is a combined cross-sectional, side view of a third embodiment of a mandrel suitable for use in the seal cartridge of FIG. 1.
Figure 10:
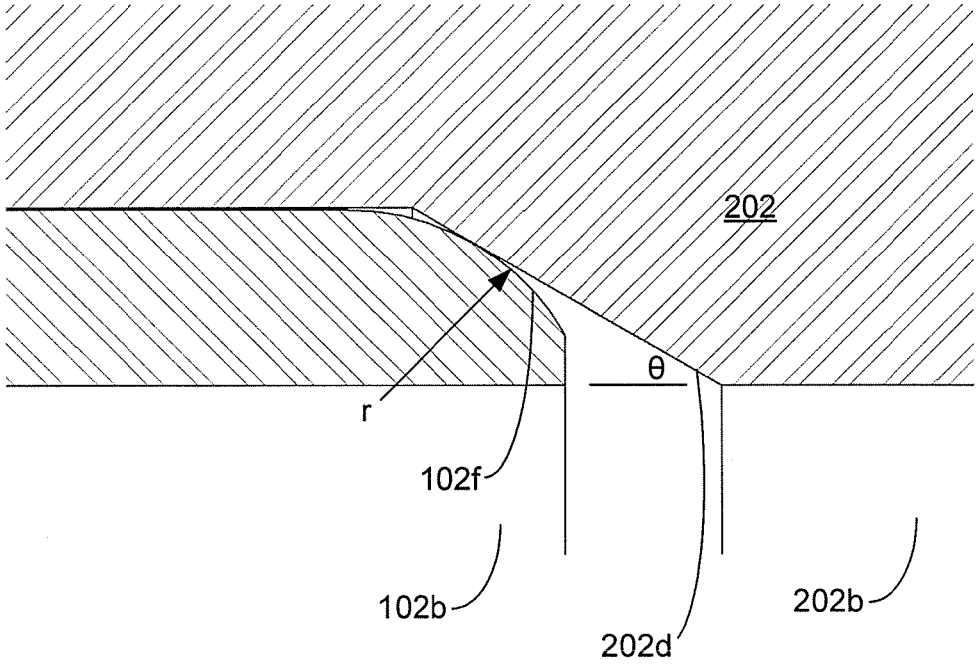
FIG. 10 is a close-up view of the mandrel of FIG. 8 disposed against the sealing surface of a rotating nozzle shaft.
Figure 11:
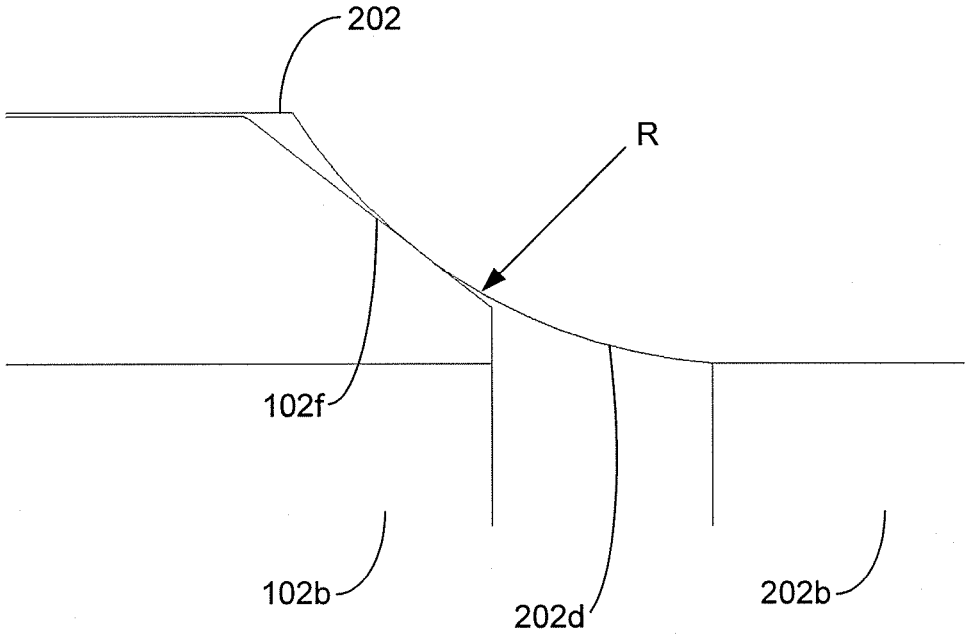
FIG. 11 is a close-up view of the mandrel of FIG. 7 disposed against the sealing surface of a rotating nozzle shaft.
Figure 12:
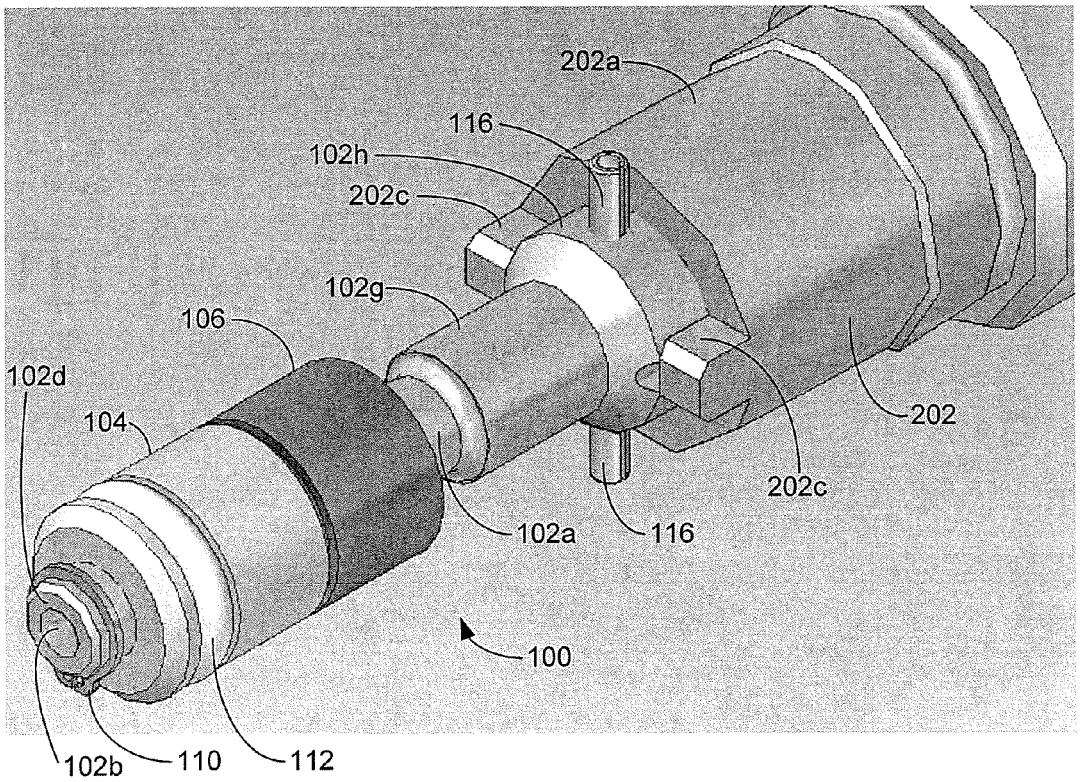
FIG. 12 is a perspective view of the seal cartridge of FIG. 1 and a portion of the rotating nozzle assembly of FIG. 2.
Figure 13:
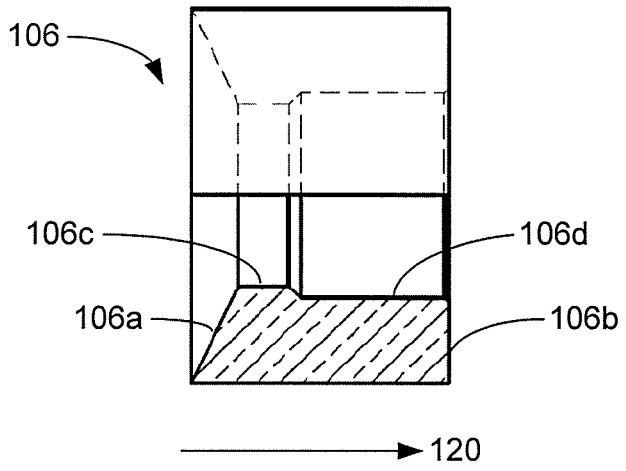
FIG. 13 is a combined cross-sectional, side view of a backup bushing.
Figure 14:
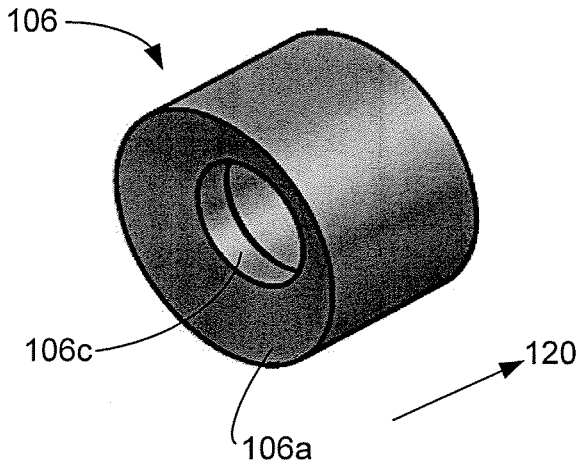
FIG. 14 is a perspective view of the backup bushing of FIG. 13.

Another feature of mandrel 102 relates to the various shapes front end 102*f* can be formed to include. These various shapes are for enabling a metal-to-metal seal to form between the front end 102*f* of the mandrel 102 and a sealing surface 202*d* on the nozzle shaft 202. This type of seal can be used instead of or in conjunction with the seal formed by the downstream seal 114. Many types of shapes are suitable for the purpose of forming a metal-to-metal seal. For example, front end 102*f* can be formed with a straight tapered shape having an angle $\alpha$ relative to the flow direction 120, as best seen at FIG. 7. In the particular embodiment shown, $\alpha$ is about 29.0 to 29.5 degrees. Instead of having a straight tapered shape, front end 102*f* can have a curved or radiused shape defined by radius 'r', as best seen at FIGS. 8 and 9. In the particular embodiment shown, radius 'r' is a constant radius of about 0.058 inches. In a further variation, the interior flow path 102*b* at front end 102*f* can be tapered outward at an angle $\beta$, as can be most easily seen at FIG. 9. This outward taper can help to provide additional sealing force. With respect to the shaft 202, the sealing surface 202*c* can have either a straight tapered shape, as shown in FIG. 10, or a curved or radiused shape, as shown in FIG. 11. In the particular embodiment shown in FIG. 10, the taper $\theta$ is about 30.0 to 30.5 degrees with respect to the direction of flow 120. In the particular embodiment shown in FIG. 11, the radius R is about 0.075 inches.

In operation, the positive pressure bias force causes the front end 112*f* of the mandrel 102 to be forced against the sealing surface 202*d* of the shaft 202. The resulting contact area between the front end 112*f* and 202*d* is designed to be relatively small such that the positive pressure bias force creates a suitably high pressure for creating the seal. The size of the contact area can be controlled by several methods. One example, is by using a straight tapered front end 112*f* that has a slightly smaller angle $\alpha$ than a straight taper angle $\theta$ on the sealing surface 202*d*. This difference in angles allows for only the tip of front end 112*f* to come into contact with the sealing surface 202*d*, thereby creating a sufficiently small contact area. Alternatively, the contact area can be minimized by using a radiused front end 112*f* against either a tapered sealing surface 202*c* (shown in FIG. 10) or a radiused sealing surface 202*d* (shown in FIG. 11). This approach allows for only a portion of the radiused front end 112*f* to come into contact with the sealing surface. The particular arrangement of a radiused front end 112*f* and a straight tapered sealing surface 202*d* is shown in FIG. 10. For this particular embodiment, the radius of the mandrel 102 initially contacts the angled surface 202*d* of the shaft 202 in a circle line of contact. The deformation of the material of both the mandrel 102 and the shaft 202 will produce a small surface area of contact. Yet another approach to minimizing the contact area is by using a straight tapered front end 112*f* against a radiused sealing surface 202*d*. This particular arrangement is shown in FIG. 11. Where a radius is used for the front end 112*f* or the sealing surface 202*d*, it is expected that less material wear will result, as compared to a configuration of a tapered front end 112*f* against a tapered sealing surface 202*d* where grooving may occur. Many other combinations of dimensions and shapes for the front end 112*f* and the sealing surface 202*d* can be utilized to enable a metal-to-metal seal, so long as the resulting contact area is small enough to allow the positive pressure bias force to create enough pressure to form a seal.

Other aspects of mandrel 102 are a first enlarged portion 102*g* and a second enlarged portion 102*h*. The first enlarged portion 102*g* enables machining of the mandrel 102 to be performed more easily and also serves as a surface to engage the retaining member 108, when removing the seal cartridge 100 from the nozzle 200. The second enlarged portion 102*h* is for providing a mounting surface for engagement mechanism 116. The engagement mechanism 116 and the retaining member 108 are discussed in more detail below. In the particular embodiment shown, both the first and second enlarged portions 102*g*, 102*h* have a diameter that is greater than that of cross-sectional diameters 102*c* and 102*e*. Additionally, second enlarged portion 102*h* has a diameter that is larger than that of first enlarged portion 102*g*. It should be noted, that mandrel 102 does not need to be machined to have first and second enlarged portions 102*g*, 102*h* and that, if absent, engagement mechanism 116 could be installed on a non-enlarged portion of mandrel 102 and would perform the same removal function as portion 102*g*.

In the particular embodiment shown at FIGS. 3-4, the internal fluid path 102*b* of mandrel 102 is 0.94 inches, the upstream diameter 102*c* is 0.181 inches, and the downstream diameter 102*e* is 0.175 inches. Also, as shown, mandrel 102 is manufactured from 17-4 precipitation hardening stainless steel. However, one skilled in the art will appreciate that other materials and dimensions are possible without departing from the concepts presented herein.

Another aspect of seal cartridge 100 is the seal assembly which is comprised of a main seal member 104 and a backup bushing 106. The seal assembly is for preventing pressurized fluid from leaking past the exterior surface 102*a* of the mandrel 102 such that all of the pressurized fluid is directed through the interior flow path 102*b* and to the nozzle assembly 200. The seal assembly can be constructed in many variations without departing from this concept. As shown, the main seal member 104 and the backup bushing 106, are disposed about the exterior surface 102*a* of the mandrel 102 with the main seal member 104 being in direct contact with the mandrel 102.

As best viewed at FIG. 3, main seal member 104 is shown as defining a downstream surface 104*a*, an upstream surface 104*b* and an interior sealing surface 104*c*. The interior sealing surface 104*c* is shown in the form of a bore and is the surface that effectuates a seal against mandrel 102 thereby preventing pressurized fluid from leaking out of nozzle assembly 200. The upstream surface 104*b* of the main seal member 104 is exposed to the pressurized fluid and is thus forced in the direction of fluid flow 120. The downstream surface 104*a* of the main seal member 104 is sloped towards the mandrel 102 in the direction of fluid flow 120. Main seal member 104 also has a recess 104*d* for accepting an upstream seal member 112 that provides for a seal between the exterior of the main seal member 104 and the interior of the rotating nozzle assembly. Thus, the pressurized fluid cannot leak around the exterior surface of the assembled seal cartridge 100 at the upstream end of the mandrel 102. In the particular embodiment shown, seal 112 is an o-ring, but may be any other suitable seal type known in the art configured to perform this function. By use of the term "upstream seal member", it is meant to identify that the seal member is located nearer the upstream end of the mandrel than it is to the downstream end of the mandrel. Further, a retainer 110 is provided to hold the main seal member 104 and the backup bushing 106 onto mandrel 102 during removal from nozzle 200. In the particular embodiment shown, retainer 110 is a retaining ring and main seal member 104 is an elastomeric component, but can be made of other suitable materials known in the art.

As shown, backup bushing 106 has an upstream surface 106*a* and a downstream surface 106*b*. The backup bushing 106 also has a bore 106*c* through which one end of the mandrel passes. The upstream surface 106*a* of backup bushing 106 is sloped such that at least a portion of the upstream surface 106*a* can be brought into contact with the sloped downstream surface 104*a* of the seal member 104. As pressurized fluid forces seal member 104 in the direction of fluid flow (towards the backup bushing 106), the sloped surfaces 104*a*, 106*b* engage to force the interior seal surface 104*c* against the exterior surface 102*a* of mandrel 102. Thus, through the use of the pressure of the working fluid itself, the seal assembly is able to apply additional sealing force against the mandrel 102. The bore 106*c* of the backup bushing 106 has a very small clearance, for example less than two thousandths of an inch around the mandrel 102. This small clearance prevents the seal member 104 from extruding past the backup bushing 106 under the action of the pressurized fluid. In the particular embodiment shown, backup bushing 106 is 9C bronze. However, the backup bushing 106 can be made of other materials suitable for accomplishing the above stated functions of the backup bushing 106.

The backup bushing 106 can also be provided with a counter bore 106*d*, as shown in FIGS. 8-9. During operation of the nozzle 200, portions of the main seal member 104 can deteriorate and separate from the main seal member 104. Some of this material can become lodged between the exterior surface 102*a* of the mandrel 102 and the bore 106*c* of the backup bushing. Once this occurs, rotational friction can increase to a point where nozzle 200 fails to rotate reliably. Adding the counter bore 106*d* has the effect of shortening the length of the surface associated with bore 106*c*, and thereby reducing the area upon which the trapped seal material from seal member 104 can rub.

Yet another aspect of the seal cartridge 100, is the retaining member 108. Retaining member 108 is for installing and removing the seal cartridge 100 to and from the rotating nozzle assembly 200. Retaining member 108 also performs the function of keeping the main seal member 104 and the backup bushing 106 in place in seal cartridge housing 212 until it is necessary to rebuild the seal cartridge 100. In the embodiment shown, mandrel 102 passes through retaining member 108 such that the downstream surface 106*b* of the backup bushing 106 rests against the retaining member 108. This arrangement allows for the backup bushing 106 to remain in position against the pressure from the main seal member 104 when the main seal member 104 is exposed to pressurized fluid. Retaining member 108 also has a connection point 108*b* for securing the seal cartridge 100 to the rotating nozzle assembly 100. In the particular embodiment shown, the connection point 108*b* includes helical threads designed to engage a complementary set of threads at connection point 212*d* on the rotating nozzle assembly 200. Other types of mechanical connections known in the art are suitable as well. Retaining member 108 also includes a head 108*a* such that an operator can use a tool to install and remove the seal cartridge 100 into and out of the seal cartridge housing 212 of the rotating nozzle assembly 200. In the embodiment shown, head 108*a* is a hex head configured for use with a wrench. However, other configurations of head 108*a* known in the art are possible.

A further aspect of seal cartridge 100 is engagement mechanism 116. Engagement mechanism 116 is for engaging the mandrel 102 of the seal cartridge 100 to the rotating shaft 202 of the nozzle assembly 200 such that the rotating shaft 202 can impart a rotational force onto mandrel 102. As shown, engagement mechanism 116 includes two pins inserted into the second enlarged portion 102*h* of the mandrel 102. Once the pins of the engagement mechanism 116 have been installed and the seal cartridge fully inserted into the nozzle assembly 200, the mandrel 102 and shaft 202 are engaged such that they will rotate together. The engagement action between the engagement mechanism 116 pins and the shaft 202 is best viewed at FIG. 7, where it can be seen that the pins of the engagement mechanism 116 engage tabs 202*c* of the shaft 202 to cause a rotation of the mandrel 102. Additionally, the friction generated from the positive pressure bias caused by the pressurized fluid will also act to engage the shaft 202 and the mandrel 102. One having skill in the art will appreciate that engagement mechanism 116 can include other means for rotationally engaging mandrel 102 and shaft 202 other than using pins and tabs without departing from the concepts presented herein. For example, polygonal mating surfaces, splines, or friction alone could be used to couple the spinning shaft 202 and the mandrel 102.

Yet another aspect of the disclosure is downstream seal member 114. The downstream seal member 114 is for providing a water tight seal between mandrel 102 and shaft 202 such that water does not unintentionally leak out of nozzle assembly 200. With downstream seal member 114 installed, the pressurized fluid cannot leak around the exterior surface of the assembled seal cartridge 100 at the downstream end of the mandrel 102. In the particular embodiment shown, downstream seal member 114 is mounted within a recess in shaft 202 and comes into contact with mandrel 102 as the seal cartridge is inserted into shaft 202. Many types of seal members are useful for this purpose. By use of the term "downstream seal member", it is meant to identify that the seal member is located nearer the downstream end of the mandrel than it is to the upstream end of the mandrel. In the particular embodiment shown, seal 114 is an o-ring type of seal member. However, any other type of seal member known in the art configured to perform this function may be used.

The above described components can be assembled to form the seal cartridge 100, as follows. First, mandrel 102 is passed through retaining member 108 from the downstream end 102*a* of the mandrel 102 until there is sufficient clearance on mandrel 102 for installing the backup bushing 106, main seal member 104 and retainer 110. In some cases, this can be when retaining member 108 is pressed against either of the first or second enlarged portions 102*g*, 102*h* of the mandrel 102. Where the first and second enlarged portions 102*g*, 102*h* are not present on mandrel 102, retaining member 108 may be inserted onto mandrel 102 until it comes into contact with engagement mechanism 116. Second, the backup bushing is mounted onto the mandrel 102 until it abuts the retaining member 108. The main seal member 104 is then mounted onto mandrel 102 until its sloped downstream surface 104*a* comes into contact with the sloped upstream surface 106*a* of backup bushing 106. Subsequently, retainer 110 is installed onto mandrel 102 to prevent the main seal member 104, backup bushing 106 and retaining member 108 from becoming removed from the mandrel 102. Seal member 112 can be installed onto the main seal member 104 at any time during the assembly process. The engagement mechanism can also be installed at any time in the process, but are preferably installed as a first step when access to mandrel 102 is easier. The disassembly of the seal cartridge 100 is the reverse. Once fully assembled, the seal cartridge 100 is ready for installation into the nozzle assembly 200. It should be appreciated that seal cartridge 100 can be configured such that the individual components of seal cartridge 100 can be installed or removed in a different order than described here.

It should also be appreciated that the assembly and disassembly of seal cartridge 100 does not need to occur in the field, and that multiple seal cartridges can be assembled or rebuilt in a setting conducive to the handling of small parts. This allows an operator in the field to easily remove a failed seal cartridge 100 from nozzle assembly 200 and to quickly install a second seal cartridge 100. Thus, the nozzle assembly 200 can be rapidly placed back into service. This is in contrast to many prior art nozzle assemblies that require the complete disassembly and replacement of the failed sealing parts in the field in order to return a nozzle assembly to service.

Referring to FIGS. 2 and 5, a nozzle assembly 200 is shown into which a seal cartridge 100 is inserted. As discussed previously, nozzle assembly 200 includes a rotating nozzle shaft 202. Similarly to mandrel 102, rotating nozzle shaft 202 defines an interior flow path 202*b* through which pressurized fluid can flow. Once nozzle shaft 202 and mandrel 102 are coupled and sealed together via engagement mechanism 116 and seal 114, respectively, interior flow paths 102*b* and 202*b* from a continuous channel through which pressurized fluid can flow from a pressurized fluid source to the nozzle head 206. Nozzle head 206 is discussed in the following paragraph. Rotating nozzle shaft 202 also has an exterior surface 202*a*.

As can be best seen at FIG. 5, nozzle assembly 200 also includes nozzle head 206. Nozzle head 206 is for discharging pressurized fluid such that it can be delivered to the surface to be treated. As shown, nozzle head 206 is coupled to rotating shaft 202 via a threaded connection wherein a metal cone and a metal seat are used. Other methods of connection may be used as well. Additionally, the metal cone and metal seat can be replaced by an elastomeric seal member. Nozzle head 206 and rotating shaft 202 can also be formed as an integral component.

Nozzle head 206 is also shown as including a plurality of interior flow paths 206*a*, each of which leads to discharge nozzle receptacles 206*b*. Nozzle receptacles 206*b* are adapted to receive a replaceable orifice to create the desired spray output from the nozzle assembly 200. In the particular embodiment shown, nozzle receptacles 206*b* are angled with respect to the direction of fluid flow 120 such that the discharged pressurized fluid will cause the nozzle head 206, the rotating shaft 202 and the mandrel 102 to rotate. This rotational force causes the nozzle assembly 200 to deliver the pressurized fluid in a circular pattern to the surface to be treated which enhances the blasting or cleaning effect of the nozzle assembly 200. Nozzle head 206 is also shown as having a protective cover 206*d* that has openings 206*e* corresponding to discharge nozzle receptacles 206*b*.

The nozzle shaft 202 can also be caused to rotate through the use of an additional power source, such as an air, hydraulic, or electric motor. In such an application, it would not be necessary for nozzle receptacles 206*b* to be angled, or to rely upon a specific water pressure to obtain a particular rotational speed. However, the rotational speed of shaft 202 can be controlled even without an additional power source through the use of a braking device 210, as shown at FIGS. 2 and 5. In the particular embodiment shown in the figures, braking device 210 is a magnetic eddy current type brake assembly. However, other braking devices can be utilized, such as centrifugal style brake shoes.

As can be seen at FIGS. 2 and 5, the rotating nozzle shaft 202 is mounted partially within a nozzle casing 204, and is supported by a plurality of bearing assemblies 208*a,b*. The bearing assemblies 208*a,b* are for allowing the rotating nozzle shaft 202 to rotate within nozzle casing 204 without undue frictional forces caused by the rotation of the shaft 202 and the thrust caused by the discharged pressurized fluid. Many types of bearing assemblies 208*a,b* are possible. In the particular embodiment shown, bearing assembly 208*a* is a pair of angular contact ball bearings that are not sealed while bearing assembly 208*b* is a sealed single radial ball bearing. However, other types of bearing surfaces known in the art and configured for this purpose, such as bushings, can be used.

Nozzle casing 204 also includes a main housing 204*a* and a pilot bearing housing 204*b* that are removably connected to each other. The pilot bearing housing 204*a* secures bearing assembly 208*b*, and other internal components of nozzle assembly 200 near the point where mandrel 102 and shaft 202 are engaged via engagement mechanism 116. The main housing 204*a* secures bearing assembly 208*a*, and the internal components of nozzle assembly 200 downstream of the pilot bearing housing. At pilot bearing housing 204*b*, a connection point 204*c* is provided for connecting the nozzle casing 204 to a corresponding connection point 212*c* on the seal cartridge housing 212. In the particular embodiment shown, the connection point 204*c* includes helical threads designed to engage a complementary set of threads at connection point 212*c* on the seal cartridge housing 212. Other types of mechanical connections known in the art are suitable as well.

As identified above, another aspect of nozzle assembly 200 is seal cartridge housing 212. Seal cartridge housing 212 is for mounting and retaining seal cartridge 100 on the nozzle assembly 200. Many configurations of seal cartridge housing 212 are possible without departing from the concepts presented herein. As previously discussed, seal cartridge housing 212 has a connection point 212*c* for connecting the seal cartridge housing 212 to the pilot bearing housing 204*b* of nozzle housing 204 and another connection point 212*d* for connecting the seal cartridge housing 212 to the seal cartridge 100. As shown, seal cartridge 212 also has an interior fluid path 212*a* that is in fluid communication with the interior fluid path 102*a* of the seal cartridge 100. The interior fluid path 212*a* of the seal cartridge housing 212 can also be placed in fluid communication with a pressurized fluid source and can be coupled to the pressurized fluid source via connection point 212*e*. In the particular embodiment shown, connection point 212*e* includes helical threads. However, other connection methods known in the art can be used. Seal cartridge housing 212 is also shown as defining an interior surface against which seal member 112 of seal cartridge 100 forms a watertight seal to prevent pressurized fluid from leaking out of the nozzle assembly 200.

In accordance with the above description, the seal cartridge 100 is installed into the nozzle assembly 200, as follows. First, seal cartridge 100 is connected to the seal cartridge housing 212 via connection points 108*b* and 212*d*. In the embodiment shown, this step is accomplished by threading the seal cartridge 100 and the seal cartridge housing 212 together. Subsequently, the seal cartridge housing is connected to the housing 204 of the nozzle assembly via connection points 204*c* and 212*c*. In the embodiment shown, this step is accomplished by threading the seal cartridge housing 212 and the nozzle housing 204 together. As this step is performed, the mandrel 102 is drawn into the shaft 202, such that the mandrel 102 and the nozzle assembly rotating shaft 202 become rotatably engaged together via engagement mechanism 116 and tabs 202*c*. Removal of the seal cartridge 100 from the nozzle assembly is the reverse of the above described steps. It should also be noted that the nozzle assembly 200 can be configured differently such that the seal cartridge 100 can be installed before the step of connecting the seal cartridge 100 to the seal cartridge housing 212.

The above are example principles. Many embodiments can be made.

We claim:

1. A rotating nozzle assembly comprising:

(a) a seal cartridge comprising:

i. a mandrel having an exterior surface and defining an internal fluid path, the mandrel having an upstream end with a first cross-sectional diameter and a downstream end with a second cross-sectional diameter that is smaller than the first cross-sectional diameter to allow pressurized fluid exposed to the mandrel to exert a positive pressure bias on the mandrel in a direction from the upstream end towards the downstream sealing end;

ii. a retaining member disposed about the mandrel, the retaining member being constructed and arranged to removably connect the seal cartridge assembly to a rotating nozzle assembly, wherein the positive pressure bias exerted on the mandrel by pressurized fluid causes the mandrel to be axially displaced with respect to the retaining member in a direction towards the downstream sealing end to form a seal between the downstream sealing end and a continuously rotating nozzle shaft;

iii. a main seal member disposed about and in direct contact with the exterior surface of the mandrel;

iv. a backup bushing disposed about the mandrel, and disposed between the retaining member and the main seal member; at least a portion of the retaining member being directly adjacent the exterior surface of the mandrel and free of the backup bushing therebetween; and v. the entire seal cartridge assembly is constructed and arranged to be oriented within and removable from a rotating nozzle assembly with the retaining member, the main seal member and the backup bushing being retained on the mandrel when the seal cartridge is removed from the rotating nozzle assembly;

vi. the nozzle assembly defining a continuous interior channel, wherein the mandrel upstream end and the mandrel downstream end are each exposed to the interior channel;

(b) a seal cartridge housing directly connected to the seal cartridge via the retaining member of the seal cartridge;

(c) a nozzle housing directly connected to the seal cartridge housing;

(d) a nozzle shaft directly coupled to the mandrel of the seal cartridge; and (e) a rotating nozzle head directly coupled to the nozzle shaft.

2. The rotating nozzle assembly of claim 1, further comprising an upstream seal member oriented to form a seal about the exterior surface of the seal cartridge.

3. The rotating nozzle assembly of claim 2, wherein the upstream seal member is disposed about and in direct contact with the main seal member.

4. The rotating nozzle assembly of claim 1, further comprising a downstream seal member oriented to form a seal about the exterior surface of the seal cartridge.

5. The rotating nozzle assembly of claim 4, wherein the downstream seal member is disposed about and in direct contact with the mandrel.

6. The rotating nozzle assembly of claim 1, wherein the main seal member is formed from an elastomeric material.

7. The rotating nozzle assembly of claim 1, wherein the backup bushing is formed from a metal.

8. The rotating nozzle assembly of claim 1, wherein the main seal member has a downstream surface that slopes towards the exterior surface of the mandrel in a direction towards the downstream end of the mandrel and wherein the backup bushing has a sloped upstream surface that is in contact with the sloped downstream surface of the main seal member.

9. The rotating nozzle assembly of claim 1, further comprising a retainer constructed and arranged to secure the main seal member, the backup bushing and the retaining member onto the mandrel, the retainer being in direct contact with the mandrel.

10. The rotating nozzle assembly of claim 1, further comprising an engagement mechanism constructed and arranged to couple the mandrel of the seal cartridge assembly to a rotating shaft of the rotating nozzle assembly, wherein the engagement mechanism includes pins and the rotating shaft includes tabs constructed to engage the pins.

11. The rotating nozzle assembly of claim 1, wherein the nozzle shaft has a sealing surface against which the downstream end of the mandrel forms a seal.

12. The rotating nozzle assembly of claim 11, wherein the nozzle shaft sealing surface has a straight tapered shape, and the downstream end of the mandrel has a radiused shape.

13. The rotating nozzle assembly of claim 11, wherein the nozzle shaft sealing surface has a radiused shape, and the downstream end of the mandrel has a straight tapered shape.

14. The rotating nozzle assembly of claim 11, wherein the nozzle shaft sealing surface has a straight tapered shape, and the downstream end of the mandrel has a straight tapered shape.

15. The rotating nozzle assembly of claim 11, wherein the nozzle shaft sealing surface has a radiused shape, and the downstream end of the mandrel has a radiused shape.

16. A rotating nozzle assembly comprising:

(a) a seal cartridge comprising:

i. a mandrel having an exterior surface and defining an internal fluid path, the mandrel having an upstream end with a first cross-sectional diameter and a downstream end with a second cross-sectional diameter that is smaller than the first cross-sectional diameter to allow pressurized fluid exposed to the mandrel to exert a positive pressure bias on the mandrel in a direction from the upstream end towards the downstream sealing end;

ii. a retaining member disposed about the mandrel, the retaining member being constructed and arranged to removably connect the seal cartridge assembly to a rotating nozzle assembly, wherein the positive pressure bias exerted on the mandrel by pressurized fluid causes the mandrel to be axially displaced with respect to the retaining member in a direction towards the downstream sealing end to form a seal between the downstream sealing end and a continuously rotating nozzle shaft;

iii. a main seal member disposed about and in direct contact with the exterior surface of the mandrel;

iv. a backup bushing disposed about the mandrel, and disposed between the retaining member and the main seal member; at least a portion of the retaining member being directly adjacent the exterior surface of the mandrel and free of the backup bushing therebetween; and (b) a seal cartridge housing directly connected to the seal cartridge via the retaining member of the seal cartridge;

(c) a nozzle housing directly connected to the seal cartridge housing;

(d) a nozzle shaft directly coupled to the mandrel of the seal cartridge; and (e) a rotating nozzle head directly coupled to the nozzle shaft; and (f) wherein the nozzle shaft has a sealing surface against which the downstream end of the mandrel forms a seal;

(g) the nozzle assembly defining a continuous interior channel, wherein the mandrel upstream end and the mandrel downstream end are each exposed to the interior channel.

17. The rotating nozzle assembly of claim 16, wherein the nozzle shaft sealing surface has a straight tapered shape, and the downstream end of the mandrel has a radiused shape.

18. The rotating nozzle assembly of claim 16, wherein the nozzle shaft sealing surface has a radiused shape, and the downstream end of the mandrel has a straight tapered shape.

19. The rotating nozzle assembly of claim 16, wherein the nozzle shaft sealing surface has a straight tapered shape, and the downstream end of the mandrel has a straight tapered shape.

20. The rotating nozzle assembly of claim 16, wherein the nozzle shaft sealing surface has a radiused shape, and the downstream end of the mandrel has a radiused shape.

* * * * *